US009723900B2

(12) United States Patent
Catanese

(10) Patent No.: US 9,723,900 B2
(45) Date of Patent: Aug. 8, 2017

(54) CLASP FOR A WATCH BRACELET

(71) Applicant: Omega SA, Bienne (CH)

(72) Inventor: Rocco Catanese, Bienne (CH)

(73) Assignee: Omega SA, Bienne (CH)

( * ) Notice: Subject to any disclaimer, the term of this patent is extended or adjusted under 35 U.S.C. 154(b) by 0 days.

(21) Appl. No.: 14/645,980

(22) Filed: Mar. 12, 2015

(65) Prior Publication Data

US 2015/0181989 A1 Jul. 2, 2015

Related U.S. Application Data

(63) Continuation of application No. 14/102,835, filed on Dec. 11, 2013, now Pat. No. 9,003,611.

(30) Foreign Application Priority Data

Feb. 3, 2013 (EP) ..... 13155028

(51) Int. Cl.
*A44C 5/24* (2006.01)

(52) U.S. Cl.
CPC ..... *A44C 5/246* (2013.01); *A44C 5/24* (2013.01); *Y10T 24/2155* (2015.01)

(58) Field of Classification Search
CPC ..... A44C 5/24; A44C 5/243; A44C 5/246; A44C 5/18; A44C 5/20; A44C 5/2047; Y10T 24/2155; Y10T 24/4782
USPC ..... 63/3.1, 3.2
See application file for complete search history.

(56) References Cited

U.S. PATENT DOCUMENTS

| | | | |
|---|---|---|---|
| 1,866,165 | A | 7/1932 | Kraemer |
| 2,057,589 | A | 10/1936 | Prestinari |
| 2,150,318 | A | 3/1939 | Dalo |
| 2,240,479 | A | 5/1941 | Borden |
| 2,262,623 | A | 11/1941 | Ritter |
| 2,456,596 | A | 12/1948 | Rowen |
| 2,461,309 | A | 2/1949 | Cedar |

(Continued)

FOREIGN PATENT DOCUMENTS

CH WO 2011095248 A1 * 8/2011 ..... A44C 5/246

OTHER PUBLICATIONS

Search Report issued in European Application No. 13155028 on May 13, 2013.

*Primary Examiner* — Abigail Morrell
(74) *Attorney, Agent, or Firm* — Oblon, McClelland, Maier & Neustadt, L.L.P.

(57) ABSTRACT

Clasp comprising a cover connected to a first bracelet strand and to a second bracelet strand, a connecting means being inserted between the second bracelet strand and the cover of the clasp, the connecting means comprising an end link sliding between a first position in which it is engaged in the cover of the clasp, and a second position in which it is outside the cover of the clasp, the end link comprising a push-button which causes a toothed element to change from a first position, in which the toothed element is in mesh with a rack toothing, to a second position, in which the toothed element is released, the end link being provided with an arresting means preventing the removal of the end link from the cover of the clasp, the arresting means comprising at least one lug, which projects into a groove arranged in the bottom of the cover and which defines two end stop members.

10 Claims, 2 Drawing Sheets

(56) References Cited

U.S. PATENT DOCUMENTS

| | | | | |
|---|---|---|---|---|
| 4,024,607 | A * | 5/1977 | Rosenberg | A44C 5/2047 24/616 |
| 5,749,128 | A | 5/1998 | Cuche | |
| 5,787,554 | A | 8/1998 | Hashimoto | |
| 5,927,577 | A * | 7/1999 | Braun | A44C 5/24 224/164 |
| 6,944,916 | B2 | 9/2005 | Kawagoe | |
| 7,289,310 | B1 | 10/2007 | Yuan | |
| 2012/0297592 | A1 | 11/2012 | Schenk | |

* cited by examiner

Fig. 1
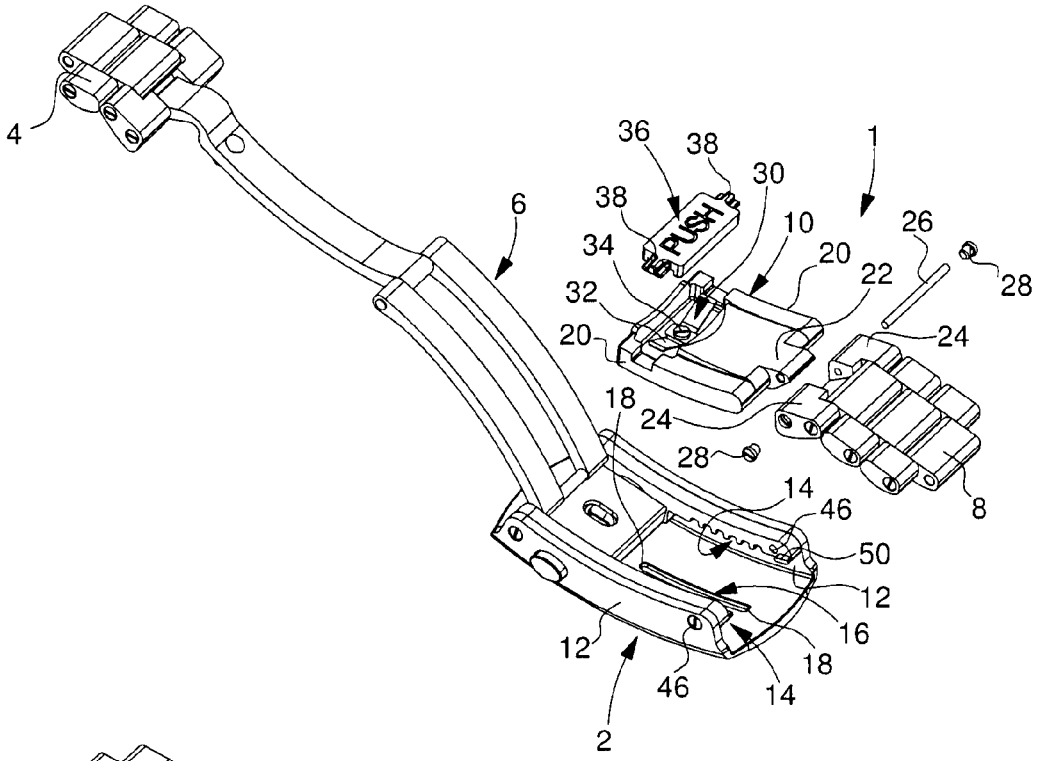
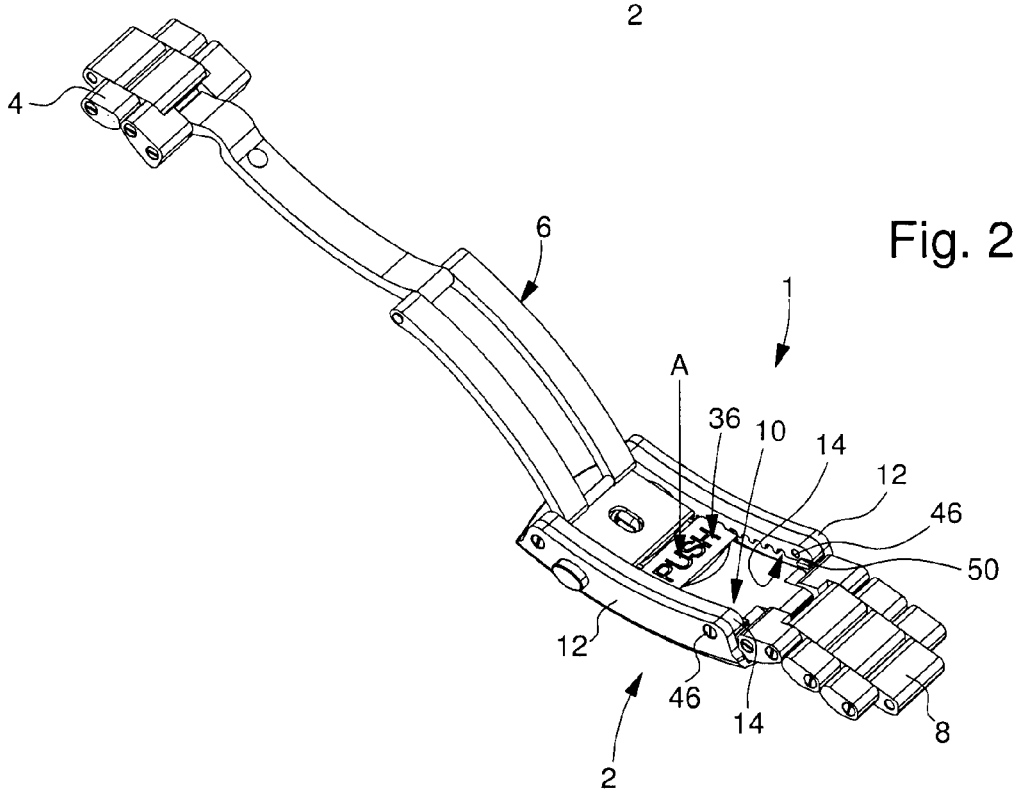
Fig. 2

CLASP FOR A WATCH BRACELET

CROSS-REFERENCE TO RELATED APPLICATIONS

This application is a Continuation of U.S. application Ser. No. 14/102,835 filed Dec. 11, 2013, which claims priority from European Patent Application No. 13155028.7 filed Feb. 13, 2013, the entire disclosure of each of which is incorporated herein by reference.

FIELD OF THE INVENTION

The present invention concerns a clasp for a watch bracelet or strap. More specifically, the present invention concerns a watch bracelet clasp comprising a means of finely adjusting the bracelet length.

BACKGROUND OF THE INVENTION

Clasps comprising means of fine adjustment of a watch bracelet length are already known in the state of the art. A clasp with fine adjustment of a bracelet length means a clasp which make it possible to adjust the bracelet length over a short travel for the best possible fit to optimise the comfort of the person wearing the watch. These clasps usually include an end link via which one of the bracelet strands is connected to the clasp cover. The end link is able to slide in a longitudinal direction of the clasp between a first "in" position in which it is housed in the clasp cover and a second "out" position in which it is outside from the clasp. Consequently, the available length for fine adjustment is determined by the travel of the end link between its first and second positions.

The end link cooperates via a toothed element with a rack toothing to index the end link position. When the toothed element is meshed with the rack toothing, the end link is immobilised. Elastic uncoupling means are provided to disengage the toothed element from its mesh with the rack toothing.

A clasp of the type described above is known, for example, from EP Patent No 11192833.9 filed under the name of the Applicant. According to one of its features, this clasp is fitted with an arresting means preventing the removal of the end link from the clasp cover. Owing to this feature, the connection between the clasp cover and the bracelet strand connected to the end link cannot be disassembled without destroying the link.

According to a preferred embodiment, the arresting means is removable, which, if necessary, allows the end link to be replaced when the wristwatch is returned to after-sales service. A threaded through hole, into which a first screw is screwed, is therefore provided in the end link. The tip of the first screw projects into a groove arranged in the bottom of the clasp cover. Since this groove is limited at each end by a stop member which marks the bottom of the groove, it is quite impossible to disassemble the fine adjustment end link once the first screw has been screwed in. Next, a cap is driven on or bonded to conceal the first screw and to keep the hole out of the user's sight. In that case however, the clasp is permanently impossible to disassemble. To overcome this drawback, it is proposed to conceal the first screw from the user's sight by means of a second screw arranged in the extension of the first screw. In this way, it remains possible to dismantle the assembly given that, in order to remove the first screw, the second screw simply needs to be taken out.

It is clear from the foregoing that, in order to ensure that it is possible to disassemble the end link, the clasp construction is relatively complex.

SUMMARY OF THE INVENTION

It is an object of the present invention to overcome the aforementioned drawbacks in addition to others by providing a watch bracelet clasp of simplified mechanical construction which operates reliably.

The present invention therefore concerns a watch bracelet clasp comprising a cover connected on a first side to a first bracelet strand and on a second side to a second bracelet strand, with connecting means inserted between the second bracelet strand and the clasp cover, the connecting means comprising an end link sliding along a longitudinal direction of the clasp between a first position, in which the end link is at least partially engaged in the clasp cover, and a second position in which the end link is outside from the clasp cover, the end link comprising a push-button which, when pressed, causes a toothed element to change from a first position, in which the toothed element is in mesh with a rack toothing, to a second position, in which the toothed element is released from its engagement with the rack toothing; the clasp being characterized in that the end link is provided with an arresting means preventing the removal of the end link from the clasp cover, said arresting means comprising at least one lug, which projects into a groove arranged in the bottom of the cover and which defines two end stop members.

As a result of these features, the present invention provides a watch bracelet clasp in which the fine adjustment mechanism of the bracelet length includes a sliding end link provided with at least one lug which projects into a groove arranged in the bottom of the clasp cover. The end link is captive or cannot be dismantled and the lug is not visible to the user, so that it is not necessary to take any measures to conceal the lug.

According to a complementary feature of the invention, the end link includes at least one skid which defines a sliding surface between the end link and the bottom of the cover.

As a result of this other feature, the contact surface between the end link and the bottom of the cover is reduced, which limits frictional forces and makes it easier to move the end link.

BRIEF DESCRIPTION OF THE DRAWINGS

Other features and advantages of the present invention will appear more clearly from the following detailed description of an embodiment of the watch bracelet clasp according to the invention, this example being given solely by way of non-limiting illustration with reference to the annexed drawing, in which:

FIG. 1 is a perspective view of the clasp of the invention in an unassembled state.

FIG. 2 is a perspective view of the clasp of FIG. 1 in the assembled state, with the fine adjustment end link in the "in" position.

DETAILED DESCRIPTION OF THE INVENTION

Figure 3:
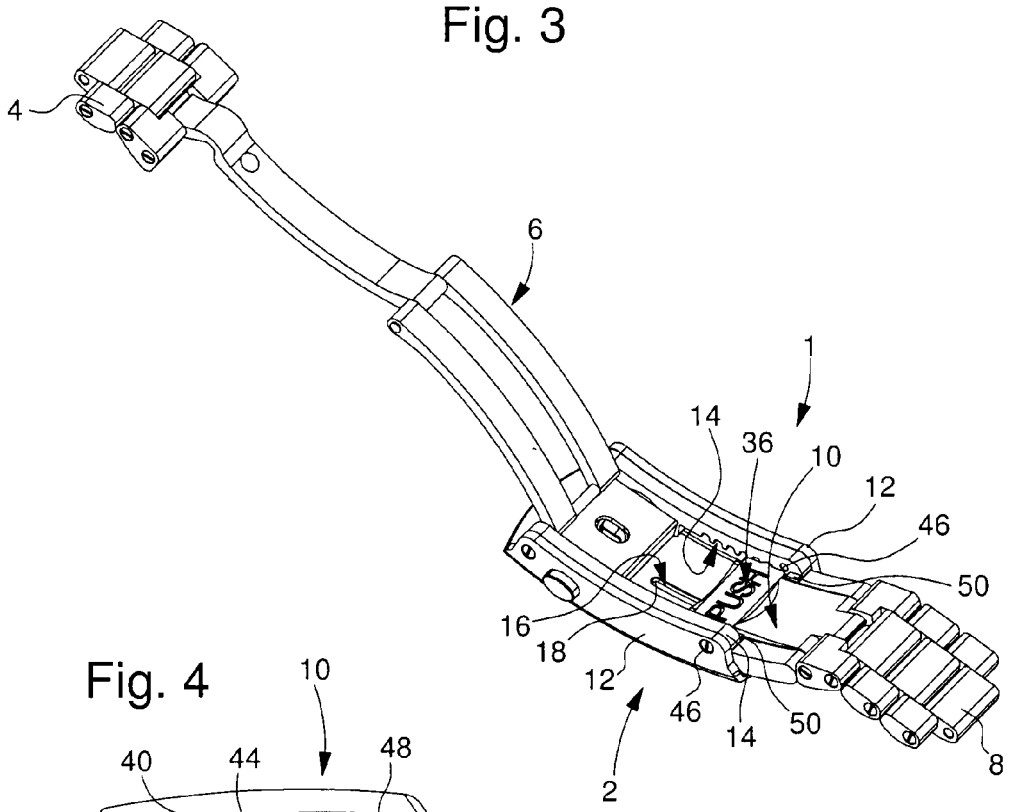
FIG. 3 is a similar view to that of FIG. 2, with the fine adjustment link in the "out" position.

The present invention proceeds from the general inventive idea which consists in providing the sliding end link of a bracelet length fine adjustment system with an arresting means which is invisible to the user. Consequently, it is not necessary to take precautions to conceal the arresting means, which substantially simplifies the design of the clasp. Moreover, the end link slides on the bottom of the clasp cover on at least one skid, which reduces the surface contact between the end link and the cover. Frictional forces are thus reduced, so that it is easier to move the end link.

FIG. 1 is a perspective view of the clasp of the invention in an unassembled state, while FIG. 2 is a perspective view of the same clasp in the assembled state. Designated as a whole by the general reference numeral 1, the clasp according to the invention includes a cover 2, connected on a first side to a first bracelet strand 4, only two links of which can be seen in the drawing. An unfolding clasp fastening system 6, whose structure is known and which will not, therefore, be described further here, is inserted between cover 2 and the first bracelet strand 4. It should be noted that the unfolding clasp fastening system 6 may be omitted and that cover 2 may be directly connected to the first bracelet strand 4. Cover 2 is connected on a second side to a second bracelet strand 8, three links of which are visible in the drawing. An end link 10 for finely adjusting the watch bracelet length is inserted between cover 2 and the second bracelet strand 8.

As can be seen upon examining FIG. 1, cover 2 has a generally U-shaped section and is provided with two wings 12 which face each other. These wings 12 each carry a rack toothing 14 on the surface thereof facing the interior of cover 2. Further, a groove 16, arranged in the bottom of cover 2, defines two end stop members 18, whose role will be described in detail below. Finally, end link 10 includes lateral guide surfaces 20 for slidably guiding said link inside cover 2 between the bottom of cover 2 and wings 12. It will be observed upon comparing FIGS. 2 and 3 that end link 10 is capable of sliding along a longitudinal direction of clasp 1 between a first position (FIG. 2), in which end link 10 is engaged in cover 2 of link 1, and a second position (FIG. 3), in which end link 10 is outside the cover 2 of clasp 1. The available length for adjusting the bracelet is determined by the travel of end link 10 between its first and second positions.

End link 10 includes a median knuckle 22 which nests between two end knuckles 24 carried by the link next to second bracelet strand 8. The links are assembled to each other by a bar 26 which passes unrestricted through knuckles 22 and 24 and which is held by two end screws 28.

End link 10 includes a groove 30 which extends transversely to the longitudinal axis of symmetry of clasp 1 and in which a V-shaped spring 32 is arranged. Spring 32, fixed in groove 30 by means of a screw 34, is covered by a push-button 36.

Push-button 36 takes substantially the form of a rectilinear actuation bar, which extends transversely to the longitudinal axis of symmetry of clasp 1 and which has a toothed element 38 at each end thereof, for example in the form of a semi-cylinder. These toothed elements 38 are intended to mesh with rack toothings 14. It will be clear that when end link 10 and its push button 36 are made to slide between the two wings 12 inside cover 2 of clasp 1, as illustrated in FIG. 2, the spring 32 which is mounted compressed, forces push-button 36 towards racks 14, so that toothed elements 38 mesh with rack toothings 14. Conversely, when push-button 36 is pressed along arrow A against the elastic return force of spring 32, toothed elements 38 are released from their engagement with rack toothings 14.

Figure 4:
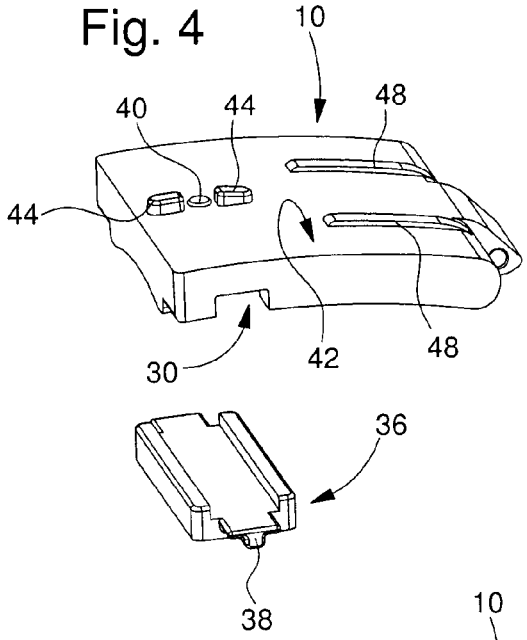
FIG. 4 is a perspective view of the fine adjustment end link turned over.
Figure 5:
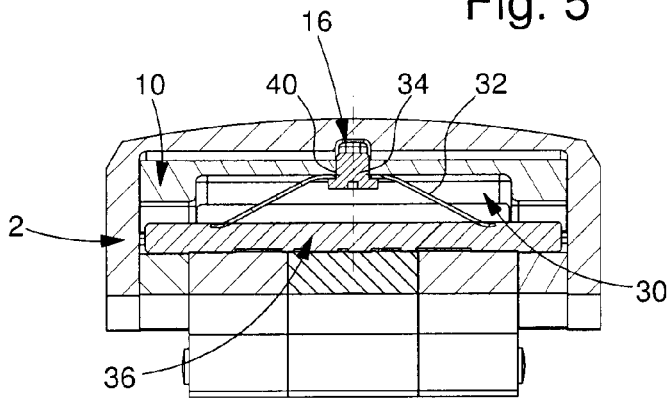
FIG. 5 is a transverse cross-section of the fine adjustment end link according to the invention.

It is observed upon examining FIGS. 4 and 5 that a threaded through hole 40, into which screw 34 securing spring 32 is screwed, is machined in end link 10. Further, according to the present invention, the bottom surface 42 of end link 10, which faces the bottom of cover 2, is provided with at least one and preferably two lugs 44 which project into groove 16 arranged in the bottom of cover 2. Since this groove 16 is limited at each end thereof by a stop member 18 which sets the limits of groove 16, it is quite impossible to disassemble fine adjustment end link 10 once it is positioned in cover 2 of clasp 1. Indeed, to assemble end link 10, the following steps are taken: end link 10 and its push-button 36 are made to slide between wings 12 of cover 2, after which rack toothings 14 are screwed by means of screws 46 onto the surfaces of wings 12 facing the interior of cover 2.

According to another feature of the invention, the bottom surface 42 of end link 10 is provided (see FIG. 4) with at least one and preferably two skids 48 via which end link 10 slides over the bottom of cover 2 of clasp 1. As a result of these skids 48, the contact surface between end link 10 and the bottom of cover 2 is reduced, which limits frictional forces and makes it easier for end link 10 to slide inside cover 2. According to a first variant embodiment of the invention which is not illustrated in the drawing, skids 48 extend over the entire length of bottom surface 42 of end link 10. According to a second variant embodiment illustrated in FIG. 1, skids 48 only extend over a fraction of the length of the bottom surface 42 of cover 2, so that even when end link 10 is pulled out into its second position (FIG. 3) in which it is outside cover 2 of clasp 1, the contact marks between skids 48 and the bottom of cover 2, remain invisible. In fact, it was realised that skids 48 tended to mark the bottom of cover 2, which left wear marks that could be seen by the user.

Finally, a pair of stop members 50 is arranged to prevent any inadvertent activation of the fine adjustment device according to the invention when the unfolding clasp fastening system is operated.

It goes without saying that this invention is not limited to the embodiment that has just been described and that various simple alterations and variants can be envisaged by those skilled in the art without departing from the scope of the invention as defined by the claims annexed to this Patent Application. It will be noted in particular that the lugs and skids may be machined in the mass of the end link. Alternatively, the end link with its lugs and skids may be made in a single piece by metal injection moulding (MIM) using a metallic powder such as titanium or steel. Moreover, a diver's extension could be placed between the end link and the second bracelet strand.

What is claimed is:

1. A clasp for a watch bracelet comprising:

a cover connected on a first side to a first bracelet strand and on a second side to a second bracelet strand, wherein a connecting means is inserted between the second bracelet strand and the cover of the clasp, the connecting means including an end link configured to slide along a longitudinal direction of the clasp between a first position in which the end link is at least partially engaged in the cover of the clasp, and a second position in which the end link is outside the cover of the clasp, wherein the end link includes a push-button which, when pressed, causes a toothed element to change from a first position, in which the toothed element is in mesh with a rack toothing, to a second position, in which the toothed element is released from its engagement with the rack toothing, wherein the end link is provided with an arresting means preventing the removal of the end link from the cover of the clasp, the arresting means including at least one lug that projects into a groove arranged in a bottom surface of the cover, the groove defining two end stop members, and wherein the end link includes at least one skid which defines a sliding surface between the end link and the bottom surface of the cover.

2. The clasp for a watch bracelet according to claim 1, wherein a bottom surface of the end link is in contact with the bottom surface of the cover only via the at least one skid that provides a gap between the bottom surface of the end link and the bottom surface of the cover.

3. A clasp for a watch bracelet comprising:

a cover connected on a first side to a first bracelet strand and on a second side to a second bracelet strand, wherein a connecting means is inserted between the second bracelet strand and the cover of the clasp, the connecting means including an end link configured to slide along a longitudinal direction of the clasp between a first position in which the end link is at least partially engaged in the cover of the clasp, and a second position in which the end link is outside the cover of the clasp, wherein the end link includes at least one skid projecting from a bottom surface of the end link, the at least one skid being rigidly fixed to the end link and extending along the longitudinal direction of the clasp to define a sliding surface between the end link and a bottom surface of the cover, and wherein said at least one skid provides a gap between the bottom surface of the end link and the bottom surface of the cover.

4. The clasp for a watch bracelet according to claim 3, wherein the end link includes at least one lug that projects into a groove arranged in the bottom surface of the cover to prevent the removal of the end link from the cover of the clasp.

5. The clasp for a watch bracelet according to claim 3, wherein the end link includes a push-button which, when pressed, causes a toothed element to change from a first position, in which the toothed element is in mesh with a rack toothing, to a second position, in which the toothed element is released from its engagement with the rack toothing.

6. The clasp for a watch bracelet according to claim 3, wherein the at least one skid extends over a fraction of a length of the bottom surface of the end link.

7. The clasp for a watch bracelet according to claim 3, wherein the end link, including the at least one skid, is made in a single piece.

8. The clasp for a watch bracelet according to claim 3, wherein the at least one skid includes two skids arranged in parallel to one another.

9. The clasp for a watch bracelet according to claim 3, wherein the at least one skid extends over an entire length of the bottom surface of the end link.

10. A clasp for a watch bracelet comprising:

a cover connected on a first side to a first bracelet strand and on a second side to a second bracelet strand, wherein a connecting means is inserted between the second bracelet strand and the cover of the clasp, the connecting means including an end link configured to slide along a longitudinal direction of the clasp between a first position in which the end link is at least partially engaged in the cover of the clasp, and a second position in which the end link is outside the cover of the clasp, wherein the end link includes at least one skid projecting from a bottom surface of the end link to define a sliding surface between the end link and a bottom surface of the cover, wherein said at least one skid provides a gap between the bottom surface of the end link and the bottom surface of the cover, and wherein the end link includes a push-button which, when pressed, causes a toothed element to change from a first position, in which the toothed element is in mesh with a rack toothing, to a second position, in which the toothed element is released from its engagement with the rack toothing.

* * * * *